United States Patent [19]

Yulkowski

[11] 4,093,284

[45] June 6, 1978

[54] DOOR CONSTRUCTION

[76] Inventor: Leon Yulkowski, 2005 Pontiac Rd. E., Pontiac, Mich. 48057

[21] Appl. No.: 706,494

[22] Filed: Jul. 19, 1976

Related U.S. Application Data

[63] Continuation-in-part of Ser. No. 530,958, Dec. 9, 1974.

[51] Int. Cl.[2] ..... E05C 3/26

[52] U.S. Cl. ..... 292/216

[58] Field of Search ..... 292/216, 336.3, 201, 292/78, DIG. 31; 49/39 A, 276, 278, 366–369

[56] References Cited

U.S. PATENT DOCUMENTS

| | | | |
|---|---|---|---|
| 176,789 | 5/1876 | Ingram | 160/229 R X |
| 2,055,688 | 9/1936 | Halinka | 292/DIG. 31 |
| 2,236,594 | 4/1941 | Dwyer | 292/218 X |
| 2,882,962 | 4/1959 | McFerrell | 160/118 |
| 3,249,379 | 5/1966 | Ross | 292/336.3 X |

*Primary Examiner*—Richard E. Moore
*Attorney, Agent, or Firm*—Robert A. Sloman

[57] ABSTRACT

In a door having a connecting link to a door frame of an improved locking mechanism on the closing edge of the door which includes a longitudinal engaging element movably mounted thereon. A corresponding longitudinal counter element is connected to the door frame; is generally parallel to and interlocked with the engaging element. The engaging element extends over at least a substantial part of the door height. Said engaging element is sufficiently movable so that it disengages the counter element so that the door may open relative to the frame. A blocking device is movably mounted on the door and in one position, retains the engaging element in locked position when the door is closed. A grip mechanism is movably mounted on the door and connected to the blocking means for moving it to a release position so that said engaging element can move to disengage said counter element. This same longitudinal engaging element and corresponding interlock counter element may be employed in connection with a door consisting of a pair of aligned leaves and wherein the engaging element of one leaf is adapted for movement relative to the counter element of the other leaf in such a manner as to disengage the respective elements permitting opening of the door leaves. The connection between the grip mechanism and the blocking device includes an elongated actuator which is pivotally mounted upon the door at one end and with its other end adapted to operatively engage the blocking device whereby inward pivotal movement of the actuator translates the blocking device to a "release" position. The grip means also include a door push as well as a door pull, both nested within openings in the door on its opposite sides, pivotally mounted upon the door. A push plate is secured to the door push along one upright edge and is adapted to operatively engage the actuator. The door pull mounts a pull rod which includes an inwardly extending hook operatively engaging the actuator from the opposite side of the door. The said door pull and door push and actuator are mounted within a hollow upright frame nested within the door and which includes an apertured web upon which is slidably supported a horizontally movable slide block. Said slide block has a normally retracted "release" position so as not to obstruct inward movements of the door push or outward movements of the door pull, and an outward "locking" position which prevents inward movement of the door push and outward movement of the door pull.

44 Claims, 10 Drawing Figures

DOOR CONSTRUCTION

RELATED PATENT APPLICATION

This patent application is an improvement over and a continuation-in-part of my copending U.S. Pat. application No. 530,958 filed Dec. 9, 1974.

BACKGROUND OF THE INVENTION

In my earlier filed application there was disclosed upon a door and along the closing edge thereof a channel-type of locking mechanism which was movably mounted upon the door and adapted to interlock with a counter element within the door frame. Some form of locking mechanism was employed which in one position thereof was adapted to lock the channel member against opening movement when the door was closed.

SUMMARY OF THE INVENTION

It is an object of the present invention to provide an improved door construction, and incorporating an improved locking mechanism on the closing edge of the door and employing a hand-push and a hand-pull mounted upon the door in such a manner as to control, through a suitable actuator, the disposition of the blocking mechanism normally restraining the longitudinal engaging channel locking member against movement.

It is another object to provide an improved construction which incorporates a complete control mechanism which will permit function changes in the nature of the door without making changes in the specific controls therefor. This includes the further object of providing variable types of push and pull plates which can be substituted and modified or switched to vary the door function as, for example, a passage door, privacy door, patio door, communicating door, entry door, classroom door, storeroom door, apartment door, dormentory door, storage door, hotel door, or deadlock mechanism. These changes in function can be obtained merely by replacement of the door pull or door push.

Another object of the invention is to be able to provide operation of pairs of doors in such a way as to eliminate concept of "active" and "inactive" doors, thus eliminating manual and automatic flush bolts, coordinators and astragals.

It is a further objective to provide a door construction which allows simple conversion to panic doors, eliminating conventional panic devices such as rim, mortise, and attendant cross bars and vertical rods, as well as eliminating the poor security normally related thereto.

These and other objects will be seen from the following specification and Claims in conjunction with the appended drawings.

THE DRAWINGS

It will be understood that the above drawings illustrate merely a preferred embodiment of the invention and that other embodiments are contemplated within the scope of the Claims hereafter set forth.

DETAILED DESCRIPTION OF THE INVENTION

Figure 3:
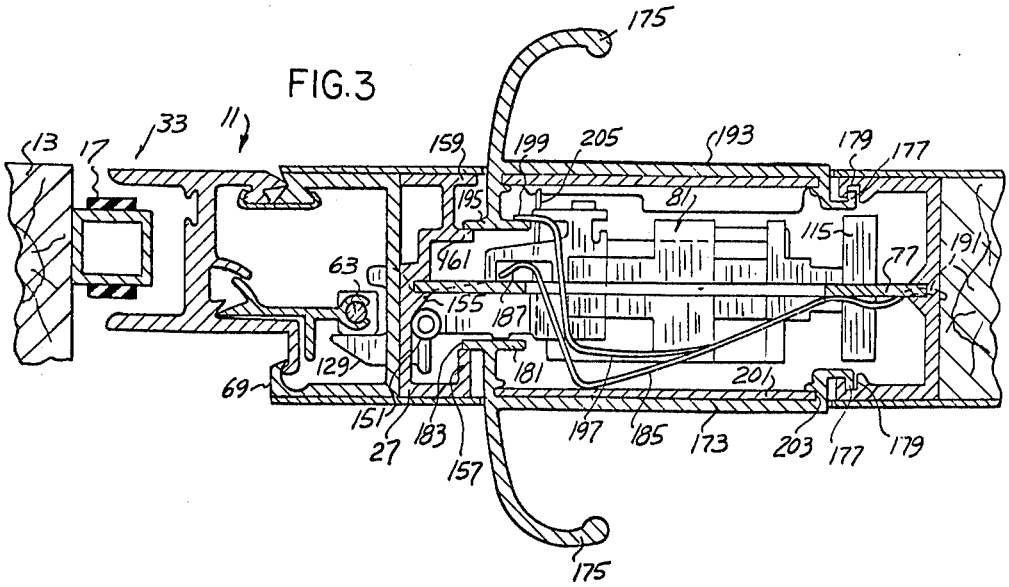
FIG. 3 is a similar view but with the slide block in a normal "release" position.
Figure 4:
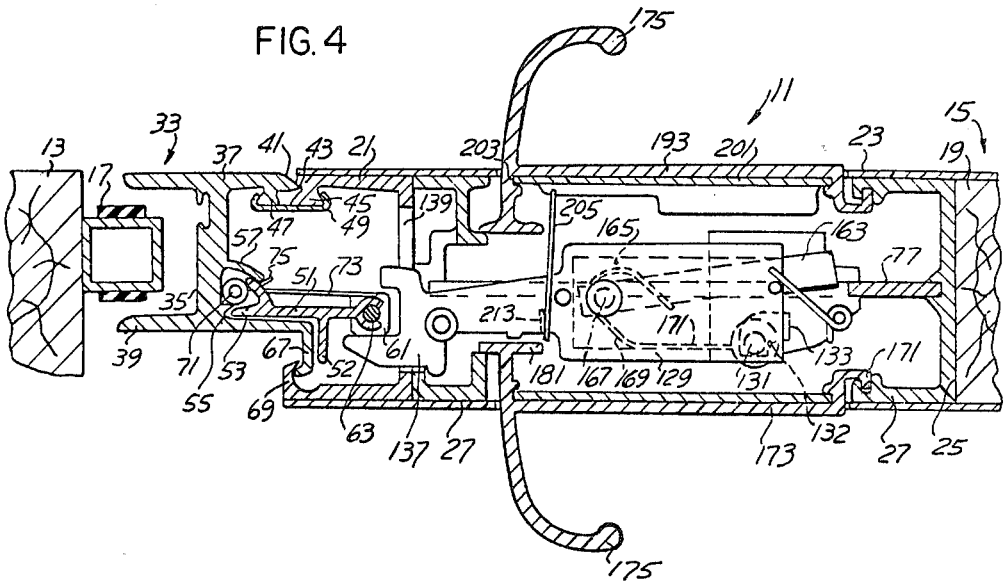
FIG. 4 is a section taken in the direction of arrows 4—4 of FIG. 1, and showing the relation between the engaging element, the blocking member the actuator, the door pull and door push.

Referring to the drawings, the present door assembly is generally indicated at 11, FIGS. 1 through 5. The door is nested within the conventional hollow frame 13, fragmentarily shown, having the usual connecting link or hinge to the door frame on one upright edge thereof referred to as the hinged side 15 of said door, as shown in FIG. 4. The present locking mechanism is arranged adjacent the closing edge of the door, FIG. 1, and adapted for registry with the upright conventional door stop or door jamb 17.

The door includes the upright stile 21 of channel form and the metal or other cover 23. Within the door assembly and adjacent the opening edge thereof, there is provided a rectangular aperture 25 within which is nested the upright open-sided frame 27. The frame abuts against stile 21 and is suitably secured thereto by fasteners 31 which extend threadedly into sleeves 29 upon the top and bottom of said frame.

The present lock mechanism includes a lock channel 33 of H-shape in cross section, hereafter often referred to as a longitudinal engaging element, and includes central web 35, outer plate 37, and inner plate 39. Channel 33 as an extrusion includes the elongated upright pivot edge 41 which nests within pivot recess 43 along the edge of stile 21. Formed upon the interior of the stile is an elongated boss 45, FIG. 4. Adjacent and spaced therefrom formed upon the interior of the channel 33 is an elongated boss 47. The two bosses are interconnected by the elongated spring channel 49 or hinge.

Figure 5:
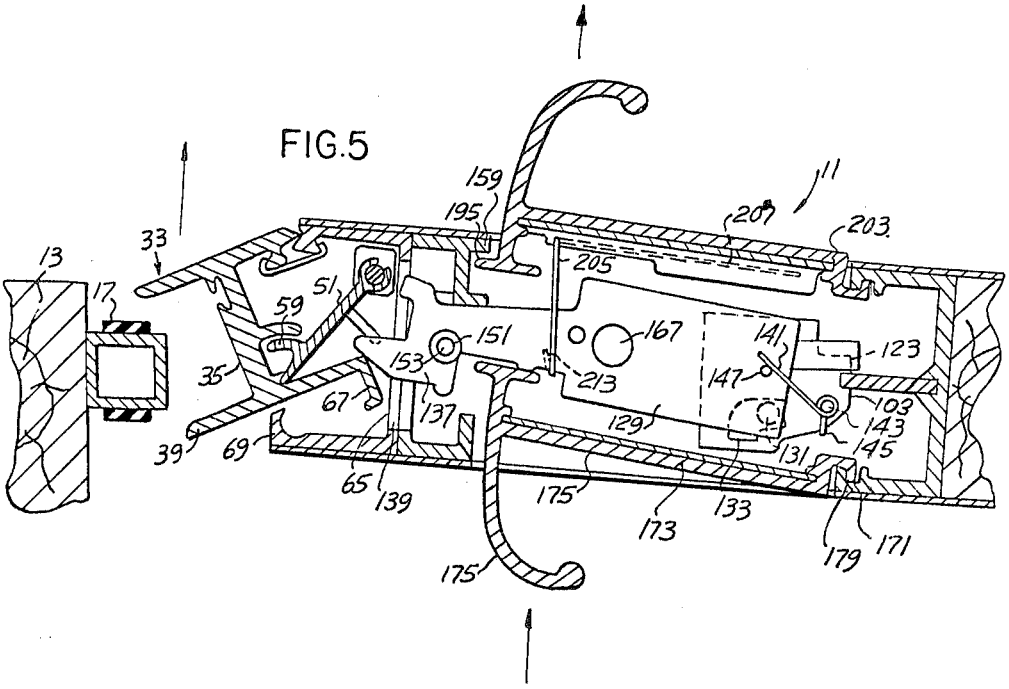
FIG. 5 is a similar view with the actuator moved by either the door push or door pull to translate the blocking member to a non-blocking position and with the engaging element pivoted so as to disengage the counter element and permit opening of the door.

The said hinge thus provides the means for movably mounting the channel member 33 with respect to stile 21, at the same time holding the pivot edge 41 of the channel within the corresponding pivot recess 43 of the stile. Accordingly, the channel member 33 or longitudinal engaging element can pivot with respect to the stile to the position such as shown in FIG. 5.

Elongated blocking member 51 including right angular block arm 52 has an elongated pivot edge 53 which nests within an elongated upright pivot groove 55 within channel 33. Said blocking member includes the arcuate boss 59 spaced from pivot edge 53 adapted for cooperative registry with the channel arcuate boss 57.

The other end of the blocking member has a pair of arcuate portions receiving the elongated pivot pin 63 mounting the sleeve 61, which may be of a nylon construction. Sleeve 61 upon one end of the blocking arm moves with respect to the back plate 65 of said stile to the release position shown in FIG. 5 under the control of the actuator 129.

Channel 33 along one longitudinal edge has the outturned stop flange 67 which is adapted to register with stop 69 upon one edge of style 21. This limits pivotal movement of channel member 33 from the position shown in FIG. 5 to the lock position shown in FIG. 4.

Elongated torsion spring 71 is interposed between channel 33 and the blocking arm 51 with one arm 73 of the spring bearing against the blocking member and with the other arm 75 of the spring bearing against channel 33. Accordingly, the torsion spring 71 tends to bias blocking member 51 to the position shown in FIG. 4 with respect to channel 33, i.e., the locking position of said channel or longitudinal engaging element.

Within the upright frame 27 which is open at its opposite sides, there is provided the upright formed web 77 defining a pair of apertures 79 within said web. The slide block 81 which consists of a pair of opposed symmetrical slide block elements 83 has internal longitudinal slots 85 to cooperatively receive portions of the web 77. Slide block elements 83 have opposed bosses 87 which extend loosely through the web slot 89 and receive the fastening rivet 91. Accordingly, the slide block elements 83 are secured together by the rivet or other fastener 91 as well as the additional fasteners 107, shown in FIG. 1.

Said slide block upon its opposite sides includes the uprights 93 which are positioned over and slidably engage the web projections 95 upon one side and upright portions of the web on the opposite side. Accordingly, the slide block is slidably and guidably mounted upon said frame web and can take the extreme retracted position thereof shown in FIG. 2, the normal non-lock position shown in FIG. 3, or the locked position of FIG. 1, i.e., a short distance to the left of its position in FIG. 3.

Figure 1:
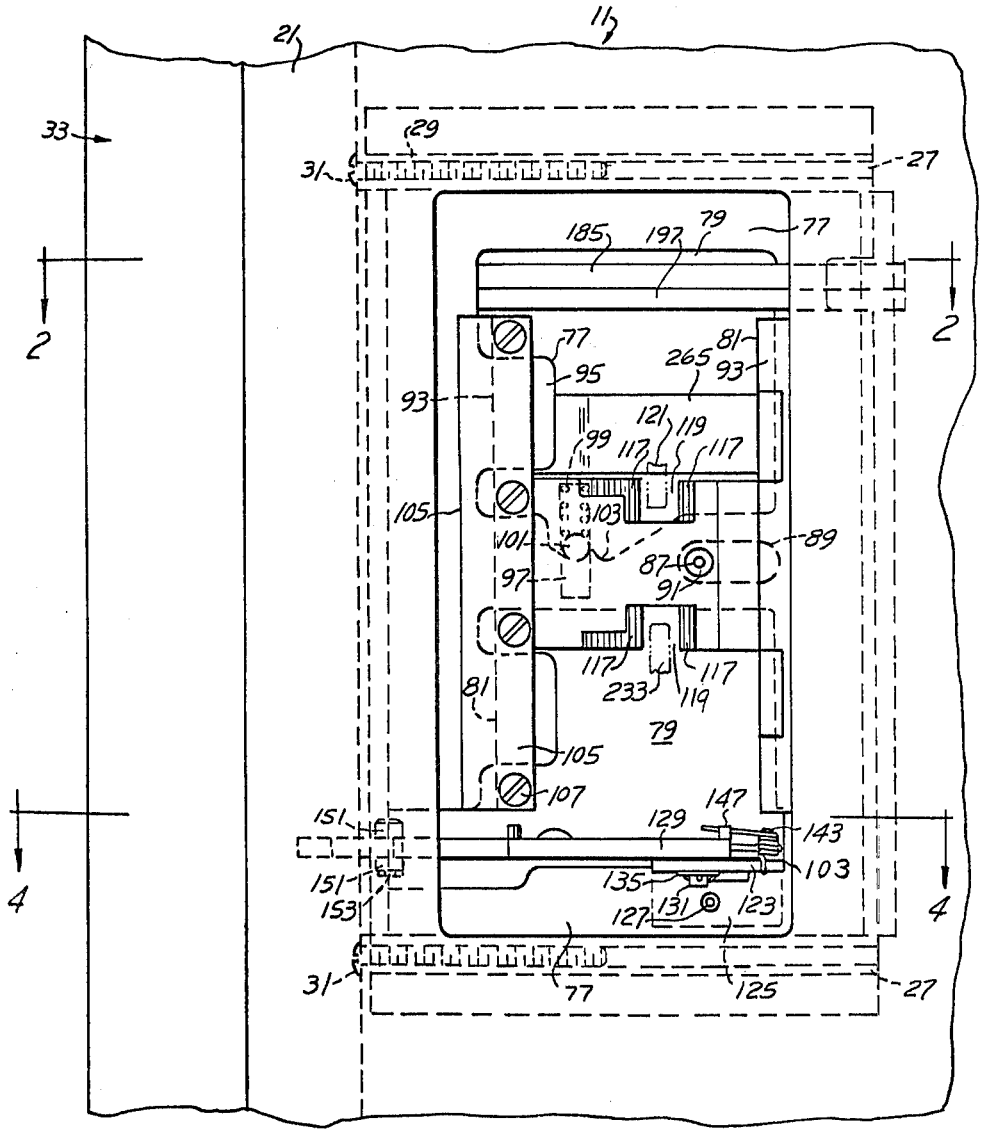
FIG. 1 is a fragmentary side elevational view of a door with the improved locking mechanism adjacent the closing edge thereof.
Figure 2:
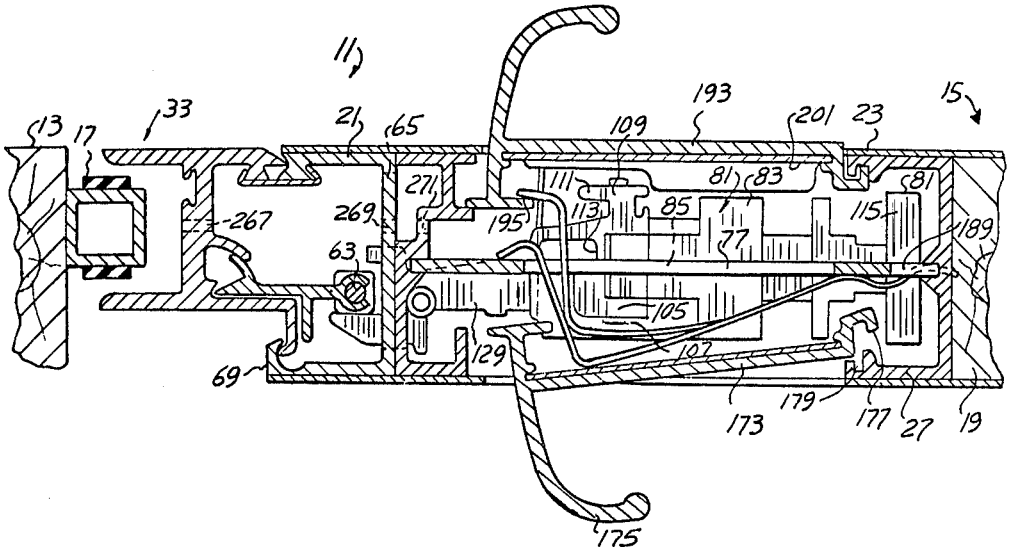
FIG. 2 is a fragmentary sectional view taken in the direction of arrows 2—2 of FIG. 1 and with the slide block shown in an extreme retracted position for assembly of the door pull and door push.

Opposed recesses 97 upon the interior of the slide block elements 83 are adapted to receive in compression coil spring 99 and ball detent 101 which selectively nests within one of the pair of notches 103 in the transverse portion of the frame web as best shown in FIG. 1.

The slide block 81 is shown in its advanced "locking" position in FIG. 1, and when moved to the normal "release" position of FIG. 3, the detent 101 nests within the other of the pair of recesses 103. The spring biased ball detent therefore is adapted to frictionally retain the slide block in the two positions mentioned, i.e., either the locking position shown or in the retracted release position of FIG. 3.

Upright lock bar 105 of rectangular shape, and right angular in form, bears against one upright edge of the slide block and is secured thereto by fasteners 107. A further lock bar 109 of irregular shape is mounted upon the opposite side of said slide block and is secured thereto by the same set of fasteners 107, FIGS. 2 and 3. Lock bar 109 includes a forwardly extending flange or door pull retainer 111 which, in an advanced position of the slide block, such as shown in FIG. 1, is adapted to interlock with the door pull plate 195 to prevent opening movements thereof.

Lock bar 109 also includes the formed guides 113 which bear against one side of the web 77. Slide block 83, at its rear end, has a pair of opposed upright wings 115, FIG. 2, which form an intergral part of the slide block elements 83. In the position of the slide block which is in extreme retracted non-normal position, for purposes of assembly, the wings 115 are in a non-holding position, relating to the door push 173 or door pull 193.

Upon opposite sides of the slide block 81 centrally thereof are the opposed pairs of spaced cam bosses 117 which define cam slots 119 and adapted to receive the rotatable cam 121, fragmentarily shown in FIG. 1. This cam forms a part of the cylinder lock 221 of FIG. 7 or may correspond to the handturn cam 233 for the hand turn 231, shown in FIG. 8.

OPERATION

In operation as hereafter described, rotation of the cam 121 by operation of a key within the lock cylinder 221 will longitudinally advance or retract the slide block 81 within frame 27, relative to the pair of detent slots 103, FIG. 1.

Positioned within the frame is the right-angular actuator base 123, FIGS. 1, 4 and 5, whose depending flange 125 bears against and is secured to a portion of the frame web by fastener 127.

Elongated formed horizontally disposed actuator 129 at one end has a depending stud 131 which extends down through an oversized L-shaped slot 133 and receives the fastener 135 to thus provide a pivot mounting of said actuator. Head 137 upon the other end of said actuator projects through a transverse slot 139 through the back wall of stile 21 and is adapted to operatively engage sleeve 61 on blocking member 51. Accordingly, inward movement of the actuator from the position shown in FIG. 4 to the position shown in FIG. 5, moves the blocking member 51 to the release position. In such position, the channel member 33, or the longitudinal engaging element is free to pivot to the inclined relase position shown.

Torsion spring 141 is supported centrally upon the upright boss 143 on the actuator base and bears against the upright boss 147 upon said actuator normally urging the actuator to the retracted or release position shown in FIG. 4 with its pin 131 bearing against the forward or lower portion of the L-shaped slot 133. The other end of the torsion spring is anchored at 145 to said actuator base.

Rollers 151 are applied to the forward end portion of actuator 129 and secured to thereto by rivet 153. In the release position of the actuator as shown in FIG. 3, rollers 151 bear against the upright cam surface 155 upon the interior of frame 27. With the actuator pivot pin 131 bearing against shoulder 132, FIG. 4, and the rollers bearing against cam 155, the actuator is constrained against initial pivotal movement. Accordingly, a compound movement is required. On operation of the push or pull the actuator will first translate inwardly, positioning the pin 131 beyond the shoulder 132.

At this time, the actuator is free to move rearwardly on continued transverse pressure to the actuator acting through the rollers 151 and cam 155. It is only then that the actuator 129 may rotate from the normal lock position shown in FIG. 4 to the operative release position for moving the blocking member 51 to non-blocking position, FIG. 5.

As shown in FIG. 3, frame 27 on one side includes the inwardly directed door push stop 157, and upon the opposite side thereof, the door pull stops 159 and 161.

Elongated inertia bar 163, FIG. 4, is nested within an undercut slot 165 on the under surface of actuator 129 and is pivotally mounted thereon by rivet 167. The inertia bar bears against the under surface of the actuator 129 and can move angularly from the position shown in FIG. 4. The torsion spring 169 is supported upon the rivet 167 and at one end 171 bears against one side of the undercut slot 165. The opposite end portion of the torsion spring engages the inertia bar 163, FIG. 4, biasing it to the position shown in FIG. 4.

The upright rectangular door push 173 with handle 175 is positioned within one of the open sides of frame 27 and pivotally mounted thereon. For this purpose, there is formed upon the door push and offset reverse-turned outwardly directed hinge flange 171 which nests within a corresponding upright pivot groove 179 formed within said frame. Upon the opposite side of said door push and inwardly thereof, there is provided an upright push plate 181 whose lip 183 bears against frame stop 157 preventing outward movement of the door push with respect to said frame.

The formed leaf spring 185 extends through the web aperture 79 and its free end is anchored as at 187 against a portion of the web. The other formed end of said leaf spring bears against the web 77, extends through anchor slot 189 in the web and the further anchor slot 191 formed within the frame 27. Leaf spring 185 functions to retain the door push 173 in the position shown in FIG. 3, with the push plate 181 bearing against the frame stop 157. The spring further functions to yieldingly resist inward movements of the door push.

Oppositely arranged from the door push is an elongated upright substantially rectangular door pull 193 which is nested within and closes off the opening upon the opposite side of the door frame and has a corresponding handle 175. The door pull is similarly mounted within said frame and includes the offset upright reverse-turned elongated hinge flange 177 which is pivotally nested within the corresponding pivot groove 179 formed within the opposite side of said frame.

The door pull includes upright pull plate 195 upon its opposite side which, in the position of the door pull shown in FIG. 3, engages the frame stop 161. When the door pull is moved to the position shown in FIG. 5, the same pull plate retainingly engages frame stop 159 to limit outward movement of said door pull. An additional elongated and formed leaf spring 197 at the end extends through the aperture 79 in the web and is anchored as at 199 against the lip of the pull plate 195. The other end of the leaf spring bears against the web 77 and and end portion thereof extends through anchor slot 189 in said web and through the further anchor slot 191 within the frame. So positioned, it appears that the leaf spring 197 is capable of initially biasing the door pull 193 to the closed release position shown in FIG. 3 and at the same time, to yieldably resist outward movements of the door pull from the position shown in FIG. 3 to the position shown in FIG. 5.

The construction of the door push 173 and door pull 193 is identical and, accordingly, either one may be nested within either side of the frame 27. Each of the door push and pull has upon its interior surface an elongated removable reinforcing back plate 201. Their opposite upright edges are nested within the corresponding opposed slots 203 upon the back surface of the respective pulls 173 and 193.

Figure 7:
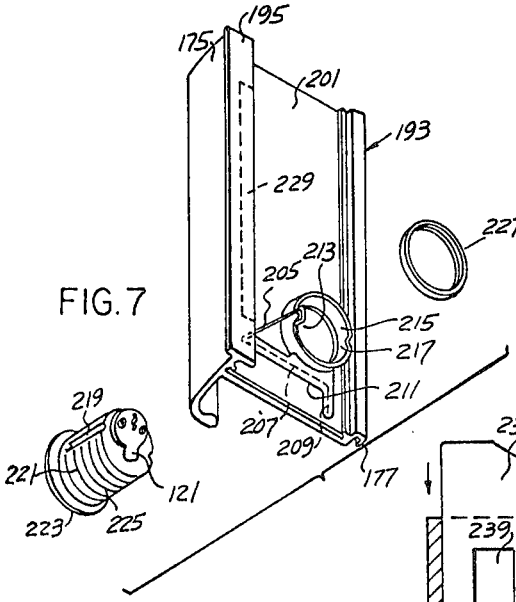
FIG. 7 is an exploded perspective view of a door pull shown in FIGS. 2 through 5.
Figure 8:
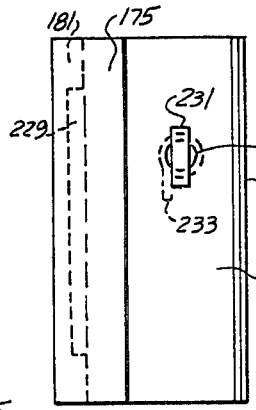
FIG. 8 is a side elevational view of a door pull or door push incorporating a hand turn piece.

Elongated irregularly shaped pull rod 205, as shown in FIG. 7, has a right-angular extension 207 which is arranged upon the interior of back plate 201 between said back plate and the body of the door pull 193. An end portion of the pull rod has a further right-angular extension 209, which is also interposed between said back plate and the door pull. Formed within said back plate is the elongated hollow outwardly extending right angular boss 211 which cooperatively receives portions 207 and 209 of the pull rod serving to anchor the pull rod with respect to the door pull. Pull rod portions 207 and 209 are anchored by the back plate 201 and its right angular boss 211 with an intermediate portion of the pull rod extending outwardly through a corresponding aperture in the back plate 201. Portions of the pull rod extend into the frame and terminate in the hook 213 which engages around a forward portion of actuator 129. Accordingly, outward movements of the door pull will cause outward trnaslatory movements of actuator 129.

When either the door pull or the door push is to be used so as to be locked by a key, there is provided within the back plate 201 an inwardly directed annular cylinder lock flange 215 having upon its opposite sides a pair of inwardly directed bosses 217 adapted to cooperatively receive the corresponding elongated slots 219 of cylinder lock 221. The cylinder lock projects through a corresponding circular aperture formed within the door push or door pull, FIG. 7, and its annular stop flange 223 bears against one side of the door pull, for example, shown at 193. The ring nut 227 is threaded over the threaded portion 225 of the cylinder lock to operatively engage an end portion of flange 215 for anchoring the cylinder lock in position. A cylinder lock, of a similar construction, can be anchored within door push 173.

While the cylinder lock is shown in FIG. 7 as being located towards the lower portion of the door pull which might correspond to the outside of a door, under certain circumstances, the cylinder lock flange 215 may be adjacent the upper end of the backing and reinforcing plate 201. This positions the cylinder lock that its cam 121 in cooperative registry within the top cam slot 119 between cam bosses 117 upon the slide block. FIG. 1 shows that the cam 121 can be positioned either in the upper position or in the lower position as shown at 233, FIG. 1. For some types of door functions, there may be the cylinder lock 221 upon the door pull 193, FIG. 7 and upon the oppositely arranged door push 173 which may correspond to the interior of the door such as within an apartment or residence, there will be employed merely a thumb turn or hand turn 231. For this purpose, there would be a smaller aperture 232 formed through the back plate 201 and the corresponding door push or door pull in order to receive the hand turn assembly 231. The opposite side of the hand turn assembly shown in FIG. 8 includes a formed cam member 233 which extends so as to be positioned within one of the cam slots 119 facing either upwardly or downwardly, FIG. 1.

In the specific described instance where the hand turn is at the upper portion of the door push 173, the corresponding cam 233 would have the position shown occupied by the cam 121, fragmentarily shown in FIG. 1. The purpose of the cam 121 on the cylinder lock or the cam 233 on the hand turn in both cases is to effect advancing or retracting movements of the slide block within the frame and with respect to the frame web between release and lock positions.

OPERATION

In the operation of the door push 173, FIG. 3, for example, assuming the slide block 81 is in its retracted or unlocked position, inward movement of the door push and the corresponding upright push late 181 can move past the forward edge of the slide block and operatively engage acutator 159. Initial inward movement translates the actuator 129 moving the actuator pin 131 inwardly so as to escape the retaining shoulder 132 on the actuator base 123. Further inward pressure causes the rollers 151 to engage the cam 155 retracting the actuator to the position shown in FIG. 5. Continued inward pressure now pivots the actuator 129 to the position shown in FIG. 5 and at the same time, the actuator moves the blocking member 51 from the blocking position of FIG. 4 to the channel release position of FIG. 5. This movement of the blocking member initiates the pivotal movement of the channel 33, also referred to as the longitudinal engaging element, from the door locking position of FIG. 4 towards the door release position of FIG. 5. Further pressure upon the door push will cause the channel 33 to move to the release position shown permitting the door to open in the direction of the arrow, FIG. 5. The door pull, being independent of the door push, actually stays in normal position, FIG. 4.

A similar result is obtained viewing FIG. 4 if outward pressure is applied to the door pull 193 through its handle 175. With the slide block 81 in its retracted release position, the door pull acting through the pull rod 205 again translates the actuator 129 from the position shown in FIG. 4, through the intermediate positions described and pivoting the actuator to the position shown in FIG. 5. The door pull 193 will open approximately to the position shown with its pull plate 195 engaging stop 159.

While FIG. 5 may show the operating positions of the door push and door pull, respectively, it is understood that each operates independently of the other. Accordingly, in FIG. 5, if the door push 173 has been moved inwardly to the position shown the door pull will remain in the position shown in FIG. 4. Likewise, when the door pull shown in FIG. 5 in its pulled position pulling the actuator has so moved, the door push 173 will remain in the position shown in FIG. 4. The pull rod hook 213 which extends around a forward portion of the actuator 129 is only loosely positioned with respect to the actuator. Accordingly, on inward pressure to the door push 173, push rod 205 and the corresponding door pull 193 will remain stationary.

In the event, however, that the slide block 81 has been advanced to the locking position either by the cylinder lock and its cam 121, FIG. 7, or the hand turn cam 233, then in that case, neither the door push or door pull will function to operate the actuator to move the blocking member to a non-blocking position. With the slide block advanced to locking position, FIG. 1, the ball detent 101 is in the forward slot 103 of the rrame web. Such position of the slide block which would be a little to the left of what is shown in FIG. 3. The corresponding lock bar 109–111 will retainingly engage pull plate 195, thus, mechanically preventing outward movement of the door pull. This forward position of the slide block also moves lock bar 105 to a blocking position, preventing inward movement of door push 173.

In the event that it is desired that either the door push or the door pull be able to function, even should the slide block 81 be advanced to its locking position, this is accomplished by cutting out the rectangular slot 229 shown in dash lines from the pull plate 195, FIG. 7. With this cut out formed within said pull plate, the lock bar 109–111 attached to the slide block even though overlapping the pull plate, will be in a clearance position so that it will be ineffective to prevent opening movement of the pull plate and the connected door pull. Similarly, if there is a rectangular slot 229 formed within the push plate 181 of the door push, FIG. 8, even if the slide block 81 has been advanced to locking position, it will be ineffective in preventing inward pushing movement of the door push, due to the clearance provided by the slot 229 with respect to lock bar 105 upon the slide block. This provides a means by which the functioning of the door can be changed without changing the mechanism of the door-locking device but merely changing or applying the slots 229 to either the door pull plate 195 or the door push plate 181.

When the door has been opened through the operation of the locking mechanism, including the actuator 129, FIG. 5, it is desirable that lock channel 33 remain in the tilted position until the door is reclosed. Without some mechanism for holding it in this position, it would be easy to manually or otherwise rotate the locking channel 33 back to the position shown in FIG. 1, while the door is open. This would prevent closing of the door to the position shown in FIG. 4.

Figure 9:
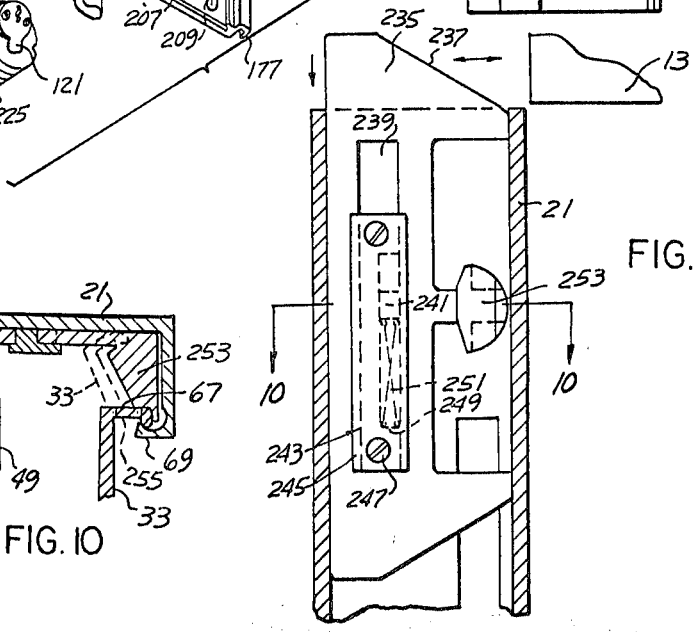
FIG. 9 is a fragmentary vertical section of the upper portion of the door rail with a door jamb engaging the latch mechanism.
Figure 10:
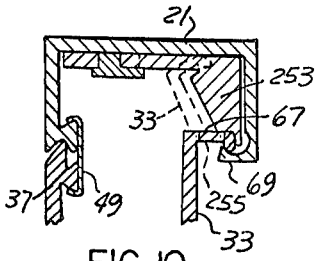
FIG. 10 is a fragmentary section taken in the direction of arrows 10—10 of FIG. 9.

Accordingly, there is provided as shown in FIGS. 9 and 10, a lock channel latch 235 having a top cam surface 237. An upright slot 239 is formed within the latch to cooperatively receive portions of the latch hold down plate 243 anchored to the web of the stile 21, by fasteners 247. The hold down plate nests within slot 239 and has along its opposite edges the laterally extending flanges 245 which slidably bear against portions of the latch 235. A coiled spring 251 anchored at 249 normally biases latch 235 to the position shown in FIG. 9. As the door closes, the cam 237 on said latch will engage a portion of the door frame or jamb 13 so as to retract the latch 235 down into the stile.

The latch 235 upon one side thereof has a right angular stop block 253, FIG. 10, which in the retracted position of the latch 235, registers with a slot 255 formed through the edge flange 67 of channel 33. Therefore, with the latch 235 in the retracted position, downward from what is shown in FIG. 9 so as to the enclosed within the stile 21, the channel 33 is free to pivot to the position shown in FIG. 5 or to the dotted line position shown in FIG. 10. However, with the door opened, the spring 251 is effective to move the latch 235 to the position shown in FIG. 9. In this position, the stop block 253 retainingly bears against a portion of the channel flange 67 mechanically preventing it from being rotated until the door is closed and the latch 235 has been retracted.

Figure 6:
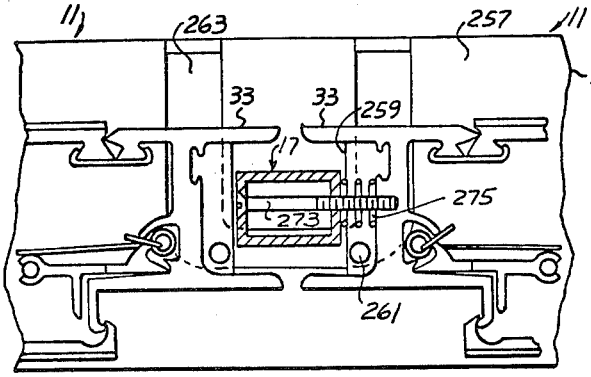
FIG. 6 is a fragmentary plan view of a door consisting of a pair of aligned leaves incorporating the present locking mechanism.

In FIG. 6, there is shown a slight modification of the present door construction which includes a pair of aligned leaves 11 within the frame 13 and overlying the frame sill 257.

Toward the lower end portion of each of the channels 33, there is secured a suitable block 259, each carrying a depending pin 261 which is movably nested within the L-shaped slots 263 formed in said sill. Accordingly, with the corresponding channel members 33 in a locked condition, as shown in FIG. 6, the pins 271 are in such position relative to the walls of the slot 263 as to prevent manual outward movement of either door until one or both of the channels 33 have been rotated to the release position such as shown in FIG. 5.

There is shown in FIG. 6 for illustration, a door stop 17 which may be interposed within the door frame 13 between the sill 257 and the header thereof and yieldably secured to one of the channels 33. The functioning of the respective channel 33 is the same as above described with respect to FIGS. 1 through 5. Fastener 273 anchors stop 17 to one channel with coiled spring 275 interposed.

A safety bar 265 or plate is shown in FIG. 1 with its ends interlocked with portions of the slide block in alignment with a portion of the lock cylinder, not shown, in order to prevent putting a wire through the push side cylinder core in order to bear against and operate the pull plate 193. Furthermore, it is contempated that the back plates 201 on the respective door push and door pull could be hardened to prevent unauthorized drilling through the respective door push and door pull.

In the preferred embodiment of the present invention, the present channel 33, also referred to as a longitudinal engaging element, extends over at least a substantial part of the door height, or the full door height. This increases its holding effect with respect to the door stop 17 and also closing off any visual space between the door and the corresponding frame 13. While the door stop 17, also referred to as a corresponding longitudinal counter element, is shown extending throughout the height of the door, the said door stop could alternately be merely short blocks at the upper and/or lower ends of the door jamb or frame 13 or could depend from the header or extend from the sill of the frame or both as desired. In all of these situations, the channel 33 would cooperatively interlock with the corresponding counter element 17.

In the foregoing description of the channel 33, also referred to as the longitudinal engaging element, the channel is referred to as movably mounted and in the preferred embodiment is shown as pivotally mounted as at 41,43, FIG. 4. The same thing is true with respect to the blocking member 51. This blocking member is movably mounted so as to take the locking position shown in FIG. 4 or the release position shown in FIG. 5. In the illustrative embodiment, the blocking member could be laterally movable, though in the illustrative embodiment, appears pivoted upon a vertical axis, but moves in a horizontal plane.

As above described with respect to FIGS. 1 through 5, the door push 173 and the door pull 193 are pivotally mounted within the frame 27. As an equivalent structure, it is contemplated that the door push and the door pull could be merely movable mounted within the frame for accomplishing a similar result. For example, a panic bar or safety bar could be pivotally mounted upon either side of the door, particularly the inner side and adapted upon application of pressure to effect inward movement of a door push similar to door push 173 of FIG. 4 to move into the position shown in FIG. 5.

By the present construction, and through the use of the slide block 81, it appears that the door push as well as the door pull as assembled within the frame without the use of any fastening devices.

It further appears that once the door push and the door pull are assembled in position, such as shown in FIG. 3, they may not be removed from the door or from the frame 27 without the door first being rotated to an open position such as shown in FIG. 5. To facilitate such removal of either of the door push or door pull, the slide block 81 must first be retracted to the complete retracted position shown in FIG. 2, with the wings 115 moved away from the corresponding pivot flanges 177. Even with the door open the lock channel must be rotated to a lock position as in FIG. 2. A stiff wire is introduced horizontally through the apertures 267, 269, 271 to mechanically retract the slide block to the position shown in FIG. 2.

The present construction of the door push and door pull is such with respect to the frame 27 and the slide block, that cylinder locks 221 may be mounted upon each of the respective door and door pull in opposing relation, i.e., back to back, in an overlapping manner and to avoid the use of cylinder rings or spacers.

It is also contemplated that merely by changing the backing plate 201 and providing the desired openings therethrough and the corresponding cylinder lock flanges, a pair of vertically spaced cylinder locks could be employed with their respective cams 121, each operably engageable with the corresponding cam slots 119 opening respectively, upwardly and downwardly, on the slide block as shown in FIG. 1. Thus, each door push or door pull could receive two cylinders per side, thus increasing keying possibilities by a factor of 3,000 times approximately when considered in conjunction with an apartment building or an office building.

In the present construction, the door operating function is controlled by the grips; namely, the door push or the door pull as opposed to any modification of the locking mechanism. Thus, the slide block can control the door function in the sense that either in its unlocked position or locked position, it may regulate inward movement of the door push or outward movement of the door pull with the exception that even in the lock positon with the respective pull plate 195 and 181 slotted as at 229, the locking function of the slide block can be bypassed where desired.

Having described my invention, reference should now be had to the following claims.

I claim:

1. In a door hinged to a door frame and a locking mechanism on the closing upright edge of the door, the improvement comprising:

said locking mechanism including a longitudinal engaging element on and carried by said closing edge and being movably mounted;

a corresponding longitudinal counter element connected to one upright edge of the door frame and being laterally opposed to and generally parallel and interlocked with the engaging element;

said engaging element and counter element extending over at least a substantial part of the door height;

said engaging element being sufficiently movable that it disengages the counter element so that the door may open relative to the frame;

a blocking means movably mounted on the door and in one position retaining the engaging element in a locked position when the door is closed;

and a grip means movably mounted on the door and connected to said blocking means for moving it to a "release" position so that said engaging element moves to disengage said counter element.

2. In the door of claim 1, said counter element being mounted on the door frame.

3. In the door of claim 1, said counter element being on the frame head or sill.

4. In the door of claim 1, the counter element being a recess.

5. In a door consisting of two aligned leaves which are hingedly mounted to a door frame at respective opposed ends thereof the improvement comprising:

a locking mechanism movably interconnecting the door leaf edges, said locking mechanism including a longitudinal engaging element movably mounted along the edge of one door leaf;

a corresponding longitudinal counter element movably mounted on the edge of the other door leaf interlocking with said engaging element;

said engaging element and counter element extending over at least a substantial part of the door height;

said longitudinal engaging element and counter element being sufficiently movable to become disengaged from one another permitting the door leaves to open relative to one another;

a blocking means movably mounted on each door and in one position retaining the respective engaging element and counter element in a locked position when the doors are closed; and a grip means movably mounted on each door and connected to said blocking means respectively, whereby pressure on one grip means moves the corresponding blocking means to a "release" position so that said engaging element moves to disengage said counter element.

6. In the door of claim 1, wherein the blocking means is movable laterally of said counter element.

7. In the door of claim 1, wherein the blocking means is pivoted on a vertical axis.

8. In the door of claim 1, wherein the blocking means is pivoted along a horizontal plane.

9. In the door of claim 1, a stop on said blocking means engageable withsaid engaging element to prevent its moving beyond the closed position in alignment with said door.

10. In the door of claim 10, said stop being mounted on said door.

11. In the door of claim 1, said engaging element and counter element extending the full door height.

12. In the door of claim 1, the connection between said grip means and said blocking means including an actuator movably mounted upon said door operatively engaging said blocking means, whereby inward movement of said actuator translates said blocking means to its "release" position.

13. In the door of claim 12, said grip means including a door push movably mounted on said door; and a push plate on said door push operatively engagable with said actuator.

14. In the door of claim 13, a stop on said door retaining said door push against outward movement relative to said door.

15. In the door of claim 12, said grip means including a door pull movably mounted on the door; and a pull means at one end secured to said door pull, extending inwardly operatively engaging said actuator.

16. In the door of claim 15, and stop means on said door preventing inward movement of said door pull relative to said door and limiting pivotal outward movement thereof sufficient to move the actuator and blocking means to its "release" position.

17. In the door of claim 13, said grip means further including a door pull nested within an opening in said door, and at one edge movably mounted on said door; and a pull means secured to said door pull extending inwardly and operatively engaging said actuator.

18. In the door of claim 14, said grip means further including a door pull nested within an opening in said door on one side thereof, and at one edge pivotally mounted on the door; a pull rod at one end secured to said door pull extending inwardly with its other end having a hook operatively engaging said actuator; and stop means on said door prevently inward movement of said door pull relative to said door and limiting pivotal outward movement thereof sufficient to move the actuator and said blocking means to its "release" position.

19. In the door of claim 18, spring means on said door yieldably restraining said door push against inward movement relative to the door and yieldably restraining said door pull against outward movement relative to said door, said spring means normally retaining said door push and door pull in inoperative position.

20. In the door of claim 13, the mounting of said door push including pivot groove upon the interior of said door; an outturned flange along one edge of said door push nested within said groove; and a movable block within and mounted on said door loosely retaining said flange within said pivot groove.

21. In the door of claim 17, the mountings of said door push and door pull including spaced opposed pivot grooves upon the interior of said door; an outturned flange along one edge of said door push and door pull respectively nested within a corresponding groove; and a movable block within and mounted on said door loosely retaining said flanges within said pivot grooves.

22. In the door of claim 17, the mounting of said actuator and said door push and door pull including a hollow open-sided frame nested within said door adjacent the closing edge thereof; an apertured web within said frame intermediate its opposite sides; said actuator being movably mounted upon said web; said door push and door pull respectively movably mounted upon and closing the open sides of said frame; and a movable block within said frame guidably mounted upon said web; said blocking having a normally retracted "release" position, so as not to obstruct inward movement of said door push and outward movement of said door pull; and an inward "locking" position which prevents inward movement of the door push and outward movement of the door pull.

23. In the door of claim 22, a lock bar upon and along one edge of said block and a further lock bar opposed to said lock bar, upon the other side of said block; movement of said block to locking position moving said lock bar so as to block manual inward movement of said door push; and moving the other lock bar so as to interlock with said door pull to prevent manual outward movements thereof.

24. In the door of claim 23, each of said lock bars being removable so that said block even in locking position, will not block or prevent manual movements of said door push and door pull.

25. In the door of claim 23, either of said lock bars being removable so that said block even in locking position, will not prevent normal movement of the door push or door pull.

26. In the door of claim 22, a cylinder lock mounted upon at least one of said door push and door pull extending into said frame and including a movable cam operatively engagable with said block for translating it between "release" and "locking" positions.

27. In the door of claim 22, a hand turn mounted upon at least one of said door push and door pull extending into said frame and including a movable cam operatively engagable with said block for translating it between "release" and "locking" positions.

28. In the door of claim 12, the mounting of said grip means upon said door including a hollow open sided frame nested within said door adjacent the closing edge thereof; an apertured web mounted within said frame intermediate its opposite sides; said grip means including a door push with a handle and a door pull with a handle, nested respectively within and closing the side openings of said frame; said doorpush and door pull each movably mounted upon said frame; the door push operatively engageable with said actuator; and a pull means on said door pull and connected to said actuator; said actuator being movably mounted upon said web; the mounting of said actuator including a depending pin thereon loosely nested within a right angular slot on said web including an intermediate stop shoulder; spring means normally biasing said actuator pin at one end of said slot and against said shoulder; said shoulder blocking and preventing unauthorized retraction of said actuator; a cam surface upon said frame; and means on said actuator engaging said cam surface normally blocking movement of said actuator; inward movement of said door push and outward movement of said door pull initially translating said actuator pivot pin beyond said shoulder; said means operatively engaging said cam surface translating said actuator and permitting movement thereof.

29. In the door of claim 28, and an inertia member resiliently biased so as to move into a blocking position relative to the actuator upon application of an unauthorized force preventing movement of said actuator.

30. In the door of claim 1, said blocking means being pivotally mounted on said engaging element.

31. In a door hinged to a door frame, and a locking mechanism on the closing edge of the door, the improvement comprising:

a hollow open-sided frame nested within said door adjacent the closing edge thereof;

an apertured web within said frame intermediate is opposite sides;

an actuator for said locking mechanism within and movably mounted upon said frame with one end projecting from said frame for controlling locking and unlocking of the locking mechanism;

said actuator at all times being disposed within said door;

a door push nested within one side of said frame and movably mounted thereon;

a door pull nested within the other side of said frame and movably mounted thereon;

said movable mountings including opposed retainers upon the interior of said frame;

a flange on said door pusn and door pull respectively, nested in said retainers;

said door push adapted to operatively engage said actuator; and a pull means secured to said door pull, extending into said frame and operably engaging said actuator; whereby selective movements of said door push and said door pull relative to said frame effect unlocking movements of said actuator.

32. In a door hinged to a door frame and a locking mechanism on the closing edge of the door, the improvement comprising:

a hollow open-sided frame nested within said door adjacent the closing edge thereof;

an apertured web within said frame intermediate its opposite sides;

an actuator within and movably mounted upon said frame with one end projecting from said frame for controlling locking and unlocking of the door;

a door push nested within one side of said frame and movably mounted thereon;

a door pull nested within the other side of said frame and movably mounted thereon;

said movable mountings including opposed retainers upon the interior of said frame;

a flange on said door push and door pull respectively, nested in said retainers;

said door push adapted to operatively engage said actuator; and a pull means secured to said door pull, extending into said frame and operably engaging said actuator; whereby selective movements of said door push and said door pull relative to said frame effect unlocking movements of said actuator; and a movable block guidably mounted on said web, said block having a normally retracted, "release" position so as not to obstruct inward movement of said door push and outward movement of said door pull, and an advanced "locking" position which prevents inward movement of the door push and outward movement of said door pull.

33. In the door of claim 32, a pull plate upon one side of said door pull; and a lock bar on said block adapted on advancing of said block to interlock with said pull plate.

34. In the door of claim 33, a pair of spaced stops on said frame adjacent said door pull; said pull plate engaging one stop retaining said pull against movement into said frame, and adapted to engage the other stop limiting outward movement of said door pull, sufficient to move said actuator to unlock position.

35. In the door of claim 32, said block having a pair of opposed laterally extending wings at one end thereof, adapted to loosely and retainingly engage said door pull and door push for retaining them within their respective retainers, in either position of said slide block.

36. In the door of claim 32, said block having one or more cam surfaces; a cylinder lock or turn piece mounted upon either of said door push and door pull, said lock or turn piece including a movable cam engageable with said block cam surface, for moving sad block etween "release" and "locking" positions.

37. In the door of claim 32, said block having a pair of cam surfaces; a cylinder lock or a turn piece mounted upon both said door push and door pull, said cylinder lock and turn pice each including a movable cam engageable with said block cam surfaces, for selectively moving said block between "release" and "locking" positions.

38. In the door of claim 32, a ball spring detent mounted on said block selectively nested within one of a pair of apertures within said web for retaining said block in either of its positions.

39. In the door of claim 35, said block having a further retracted position, which locates said wings as to permit disengagement of said door push and door pull mountings.

40. In the door of claim 1, said door including an upright stile; said engaging element, when moved to disengage from said counter element, being positioned within said stile; and a latch plate movably mounted within said stile and including a cam surface engageable with the door frame on closing the door for moving said latch plate; said latch plate having projecting means retainingly engaging said engaging element to prevent movement of the engaging element to its closed position while the door is open, there being a clearance recess in said engaging element adapted to loosely receive said projecting means when the door is closed and said latch retracted, and spring biasing means engaging said latch plate.

41. In the door of claim 39, said block being manually movable by exterior means to said fully retracted position to release and disengage said door push and door pull only when the door is open.

42. In the door of claim 37, said door push and door pull adapted to each mount an additional cylinder lock thereby greatly increasing keying possibilities.

43. In the door of claim 31, said door push and door pull being symmetrical in size and shape and interchangeable from push to pull sides of the door.

44. In a door hinged to a door frame, and a locking mechanism on the closing edge of the door, the improvement comprising:

a hollow open-sided frame nested within said door adjacent the closing edge thereof;

an apertured web within said frame intermediate its opposite sides;

an actuator within and movably mounted upon said frame with one end projecting from said frame for controlling locking and unlocking of the door;

a door push nested within one side of said frame and movably mounted thereon;

a door pull nested within the other side of said frame and movably mounted thereon;

said movable mountings including opposed retainers upon the interior of said frame;

a flange on said door push and door pull respectively, nested in said retainers;

said door push adapted to operatively engage said actuator; and a pull means secured to said door pull, extending into said frame and operably engaging said actuator; whereby selective movements of said door push and said door pull relative to said frame effect unlocking movements of said actuator; and spring means on said frame respectively engageable with said door push and door pull, yieldably resisting inward and outwardly movements of said door push and door pull respectively.

* * * * *